United States Patent [19]
Smucker et al.
[11] Patent Number: 4,478,710
[45] Date of Patent: Oct. 23, 1984

[54] SEPARATION METHOD AND APPARATUS

[75] Inventors: Alvin J. M. Smucker, East Lansing; Shawn L. McBurney, Haslett; Ajit K. Srivastava, East Lansing, all of Mich.

[73] Assignee: Board of Trustees Operating Michigan State University, East Lansing, Mich.

[21] Appl. No.: 497,053

[22] Filed: May 23, 1983

[51] Int. Cl.[3] ..... B03D 1/24
[52] U.S. Cl. ..... 209/17; 209/170; 209/165
[58] Field of Search ..... 209/17, 2, 3, 168, 170, 209/211, 164, 165; 134/25.3; 15/3.14, 3.15

[56] References Cited

U.S. PATENT DOCUMENTS

| | | | |
|---|---|---|---|
| 3,278,022 | 10/1966 | Moeschler | 209/2 |
| 3,279,597 | 10/1966 | Reinhall | 209/17 |
| 3,893,922 | 7/1975 | Bobo | 209/211 |
| 3,959,150 | 5/1976 | Frykhult et al. | 209/211 |
| 4,012,316 | 3/1977 | Ostlund et al. | 209/17 |
| 4,076,548 | 2/1978 | Bundy | 209/5 |
| 4,253,942 | 3/1981 | Gäumann | 209/17 |
| 4,287,707 | 9/1981 | Persoons et al. | 209/3 |
| 4,355,433 | 10/1982 | Dietrich | 15/3.14 |

FOREIGN PATENT DOCUMENTS

| | | | |
|---|---|---|---|
| 035870 | 3/1977 | Japan | 209/170 |
| 395114 | 12/1973 | U.S.S.R. | 209/17 |
| 48010 | 10/1980 | U.S.S.R. | 209/3 |

OTHER PUBLICATIONS

Gates, C. T., J. Aust. Inst. Agric. Sci., 17:152–154, (1951).
Fribourg, H. A., Agron. J., 45:334–335, (1953).
Fehrenbacher, J. B., et al., Agron. J., 47:468–472, (1955).
Kawatake, M., et al., Bull. Tokai-Kinki Natl. Agric. Exp., Stn. Jpn., 11:66–70, (1964).
Williams, T. E., et al., J. Br. Grassl. Soc., 12:49–55, (1957).
Cahoon, G. A., et al., Am. Soc. Hort. Sci., 78:593–596, (1961).
Shalyt, M. S., et al., Int. Symp. Leningrad, Nauka, USSR, pp. 204–208, (1968).
Kolesnikov, V. A., p. 269, Mir Publishers, Moscow, USSR.
Brown, G. R., et al., J. Range Manage., 29:506–507, (1976).
Bohm, W., In: Methods of Studying Root Systems, Springer-Verlag., pp. 116–117, (1979).
Voorhees, W. B., et al. Agron. J. 72:847–851 (1980).
Srivastava, A. K. et al., Am. Soc. Agric. Eng. Trans., 25: (4), (In press), (1982).

*Primary Examiner*—Frank W. Lutter
*Assistant Examiner*—William Bond
*Attorney, Agent, or Firm*—Ian C. McLeod

[57] ABSTRACT

An elutriation apparatus which combines pressurized liquid jets and the low energy air bubble flotation for the separation is described. A manifolded set of multiple apparatus which increases operator efficiency is described. Quantitative separation of roots is achieved by the apparatus by a closed system of mechanical separations using water and air to isolate and deposit roots on a sieve submerged in the water. The method provides a rapid, quantitative and inexpensive method for measuring plant root responses to soil biological, chemical, and physical conditions.

14 Claims, 14 Drawing Figures

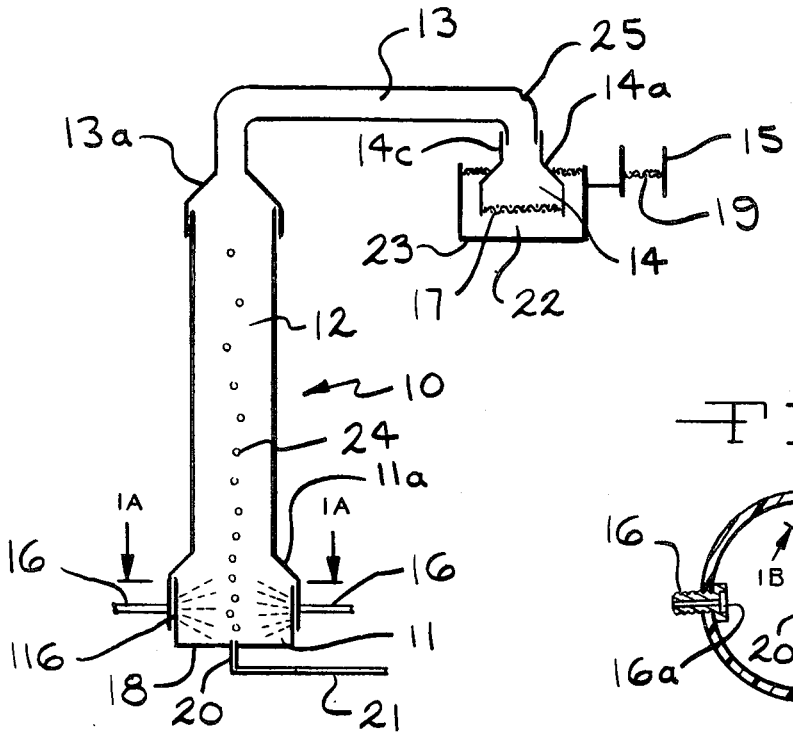
FIG. 1
FIG. 1A
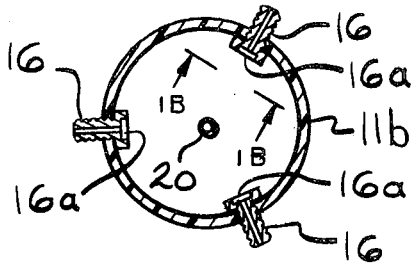
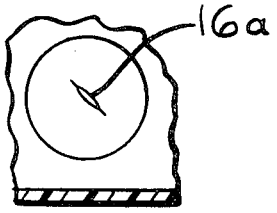
FIG. 1B
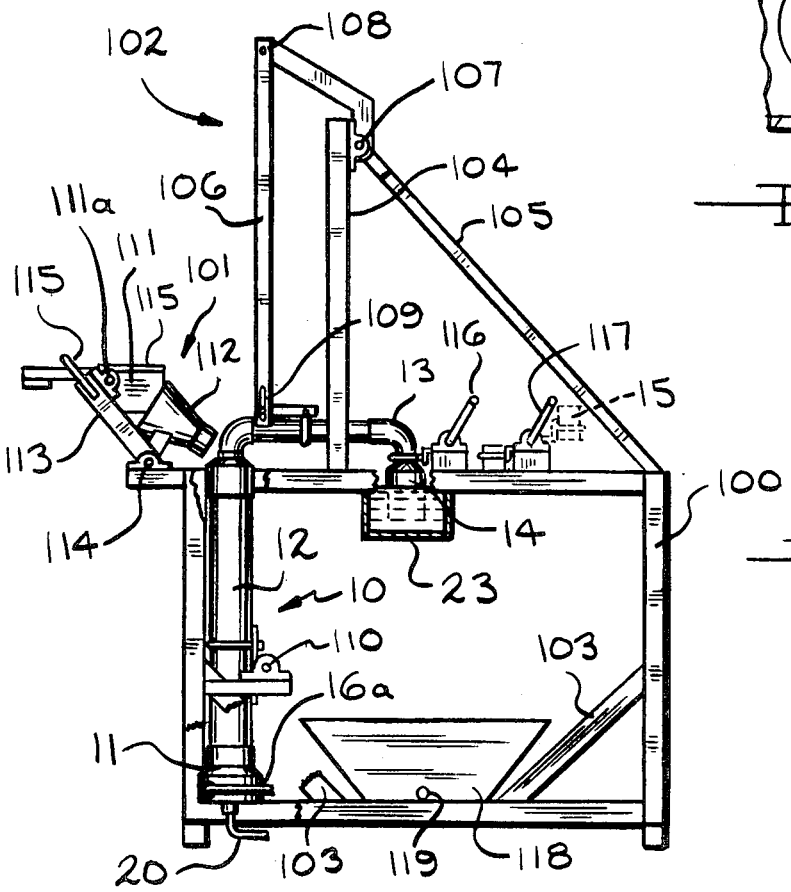
FIG. 2

SEPARATION METHOD AND APPARATUS

BACKGROUND OF THE INVENTION

The present invention relates to an elutriation apparatus and method. In particular the present invention relates to an elutriation apparatus which uses a unique combination of air bubble and fluid classification.

PRIOR ART

The paucity of quantitative and inexpensive methods for separating mineral and biological materials from soil samples has severely limited comprehensive analysis of plant root responses to adverse soil environments. Gates, C. T. J. Aust. Inst. Agric. Sci. 17:152–154 (1951) proposed a technique for placing soil-root samples into screened cradles agitated in a large tank filled with water until the roots were washed clean and collected on a sieve. Fribourg, H. A. Agron. J. 45:334–335 (1953) soaked soil monoliths in screen trays and immersed them in large drums of water. Fehrenbacher, J. B., et al. Agron. J. 47:468–472 (1955) developed a shaker-type machine that gently put the root-soil samples into suspension by shaking and separating the roots from the soil with a sieve. Kawatake, M., et al. Bull. Tokai-Kinki Natl. Agric. Exp. Stn. Jpn. 11:66–70 (1964) developed a similar fluctuating washing machine where shaking or agitation speeds could be varied. Williams, T. E., et al. J. Br. Grassl. Soc. 12:49–55 (1957) constructed a washing machine with rotating sieves in which a continuous spray of water was directed to wash the soil free from the roots. Cahoon, G. A., et al. Am. Soc. Hort. Sci. 78:593–596 (1961) developed a large mechanical device for quantitatively separating tree roots from soil materials by using the kinetic energy of water. However, the large separation chambers greatly extended the washing time on the large 25 cm samples. Shalyt, M. S., et al. Int. Symp. Leningrad, Nauka, USSR pp 204–208 (1968) and Kolesnikov, V. A. p. 269. Mir Publishers, Moscow, USSR. also described a root washing machine which mechanically washed soil from previously soaked samples. Roots with soil particles adhering to them, fell onto a swinging sieve placed inside a bath where they were washed clean. More recently, Brown, G. R., et al. J. Range Manage. 29:506–507 (1976) described a relatively low cost root washing machine using water spray and agitation which could be constructed from readily available commercial components.

Investigations comparing manual and mechanized root-soil separation procedures (Bohm, W. In: Methods of studying root systems. Springer-Verlag. p 116–117 (1979)) have demonstrated that both approaches were labor-expensive and little is known of their precision, especially with respect to the retention of fine root laterals and root hairs. Soil texture, structure, and degree of compaction as well as the content of organic matter greatly influence the precision and time necessary to wash roots free of debris. Although currently used mechanized washing procedures may be more consistent, even though a secondary washing or sorting is necessary, their use has been primarily limited to coarser textured soils. Recent reports indicate that chemical dispersing agents may partially disperse fine textured soils making them suitable for the mechanical extraction of roots (Bohm, W. In: Methods of studying root systems. Spring-Verlag. p 116–117 (1979)).

Several methods, including the application of water spray jets to root-soil samples on screens, reciprocating enclosed root-soil samples into and out of a water bath containing dispersing agents, and sonication of soaked root-soil samples, have been used. All of these methods were very labor intensive and at best, semi-quantitative.

Recent advances in the application of computer technology (Voorhees, W. B., et al. Agron J. 72:847–851 (1980)) for the rapid measurement of root systems washed free of soil and the greater need for more quantitative root data for whole plant systems, clearly indicate a greater need for the developement of a precise and inexpensive method for the rapid separation of roots and other biological systems from soil materials.

Knowledge of plant root responses to both favorable and unfavorable soil conditions is fundamental to our understanding of the complex root soil interface. One of the greatest hindrances to the frequent measurements of the morphological and physiological responses of plant roots to soil environmental conditions has been the absence of an inexpensive method for quantitatively separating the soil from roots and other biological materials.

OBJECTS

The primary object of this invention is to provide a method and apparatus which efficiently separates roots from compacted soils without destroying small lateral roots, nodules, and other fragile root structures. It is further an object to provide an inexpensive method for quantitatively separating roots and other biological materials from soils ranging in texture from sand to clay with an apparatus which is not influenced by soil type, or plant type (strain). These and other objects will become increasingly apparent by reference to the following description and the drawings.

IN THE DRAWINGS

FIG. 1 is a schematic representation of the root-soil elutriation apparatus of the present invention. The apparatus is composed of five areas: high kinetic energy washing chamber 11, and an elutriation chamber 12, in a tubular conduit 10, transfer tube 13, submerged low kinetic energy primary sieve 14, and secondary sieve 15. The transfer tube 13 lifts off the upper end of the conduit 10 for removal of coarse mineral fraction from the former sample by tipping the conduit 10 and for the addition of the new root and soil sample. Roots are transferred from the low energy sieve 14 by inverting and washing roots onto a very fine secondary sieve 15.

FIG. 1A is a cross-sectional view of the washing chamber 11 along line 1A—1A of FIG. 1 in the tubular conduit 10 showing the tangential positioning of spray nozzles 16 to a circle around the axis of the conduit 10 as shown in FIG. 1.

FIG. 1B is a front view in partial section along line 1B—1B of FIG. 1A.

FIG. 2 is a side view of a more advanced elutriation apparatus wherein multiple apparatus as shown in FIG. 1 are mounted linearly on a frame 100 with a charging manifold 101 which increases the efficiency of separating roots from soil materials by the hydropneumatic elutriation method.

Figure 4:
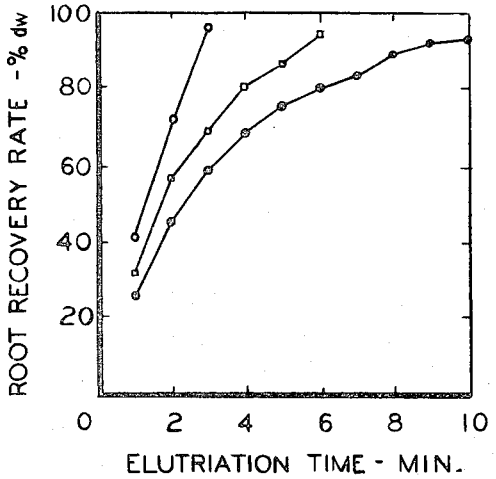

FIG. 4 shows the influence of soil texture on the time and recovery rates of dry bean roots (*Phaseolus vulgaris* cv. Seafarer) separated by the hydroelute apparatus. One hundred percent of the roots washed free of soil were those which traversed the primary sieve and were retained on a 75 micrometer sieve. Inlet pressures of water and air were 3.9 and 0.7 kg $cm^{-2}$.

Figure 5:
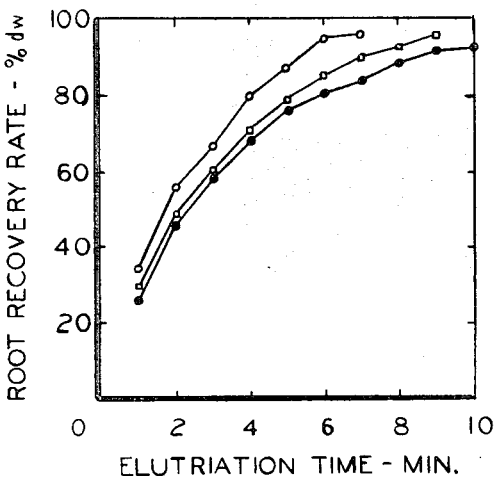

FIG. 5 shows the influence of presoaking soil samples in sodium hexametaphosphate (50 g/liter) on the separation rate of bean roots from a Charity clay. The hydroelute conditions are given in the description of FIG. 4.

Figure 6:
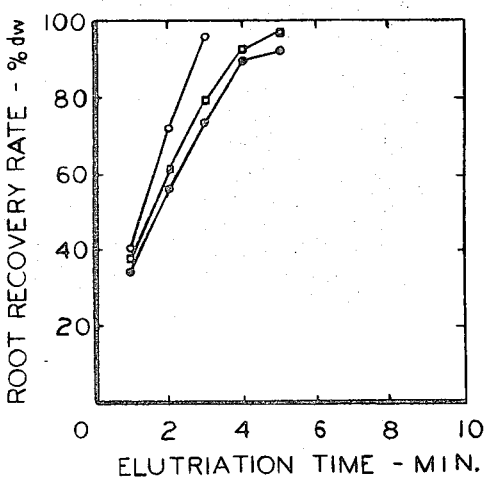

FIG. 6 shows the release and recovery of roots from bean, oat, and corn plants grown in sand for 2 weeks using the method described for FIG. 4.

Figure 7:
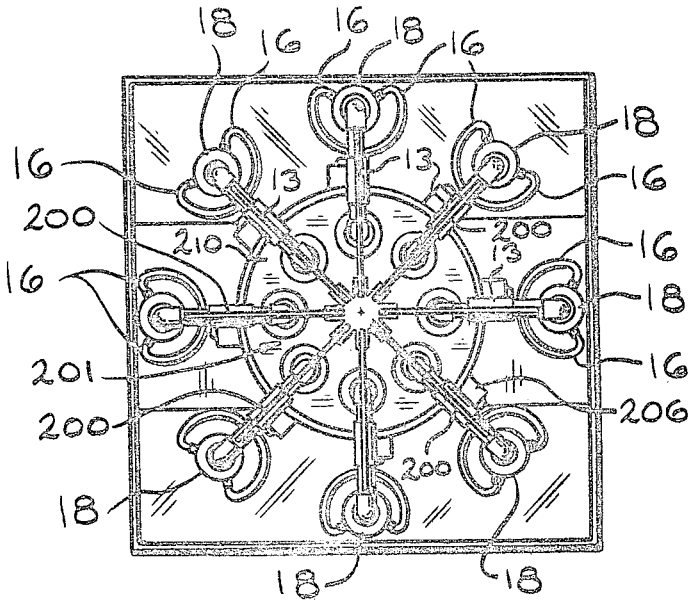

FIG. 7 is a plan view of the preferred apparatus wherein the elutriation apparatus are mounted in a circle with their axis parallel to each other.

Figure 7A:
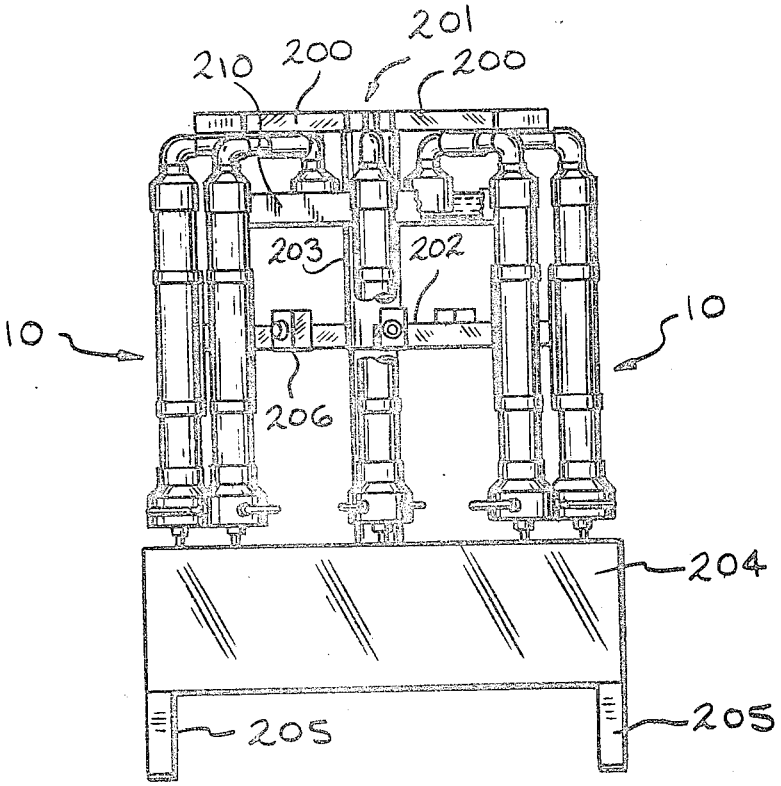
Figure 7B:
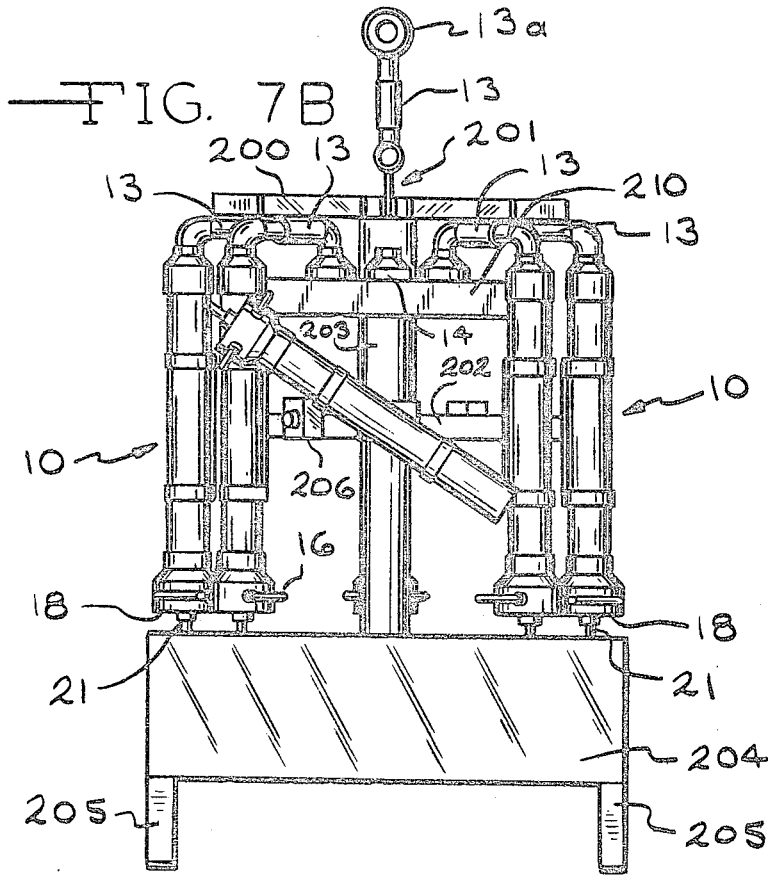

FIGS. 7A and 7B are front views of the apparatus of FIG. 7.

Figure 8:
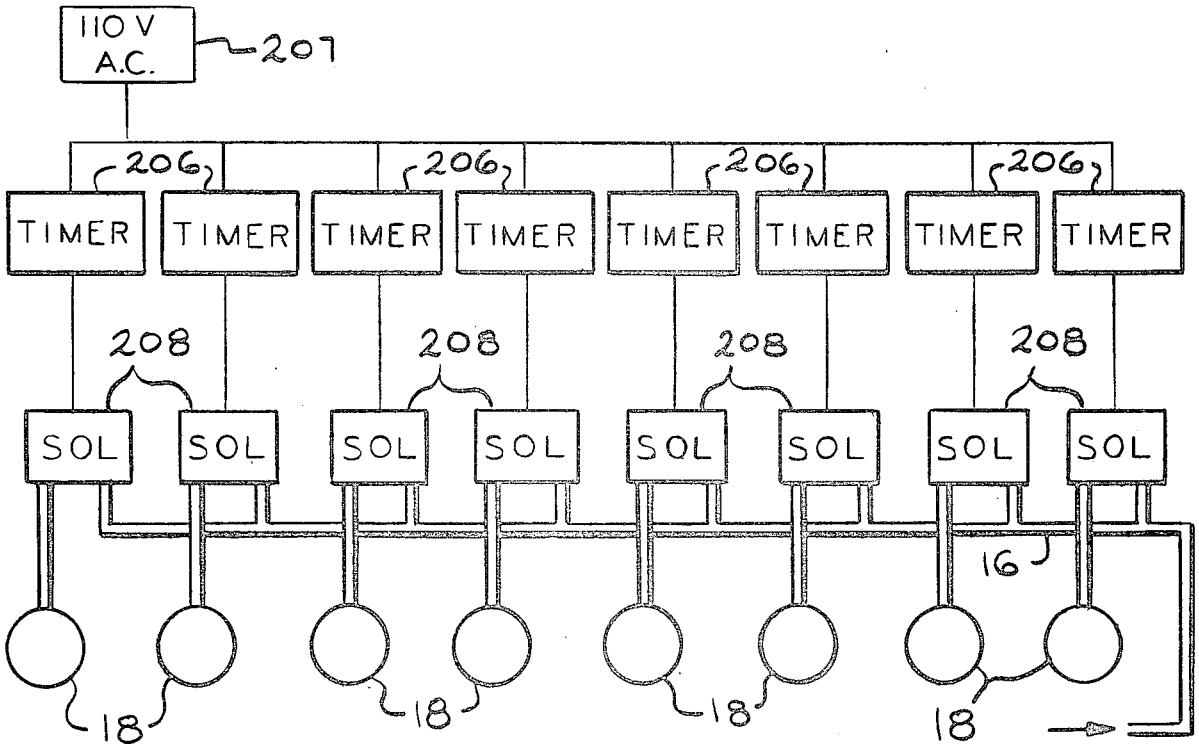

FIG. 8 is a schematic view of the water flow to the nozzles particularly illustrating solonoids controlled by timers for regulating the time of water flow.

GENERAL DESCRIPTION

The present invention relates to an elutriation apparatus for the separation and classification of a heterogeneous mixture of solids including filamentary materials having components with different specific gravities by means of a liquid classification which comprises: a tubular conduit (10) having a vertically oriented longitudinal axis and opposing upper and lower ends along the axis, wherein the lower end is closed; a tubular transfer tube (13) connected to the upper end of the conduit and leading away from the axis of the conduit with an opening from the branch (14); air bubble generating means (20) through the lower end of the conduit for providing a flow of air bubbles vertically through the conduit and parallel with the axis and out an air vent hole (25); high kinetic energy generating nozzle means (16*a*) for introducing at least one stream of fluid inside the conduit adjacent to the air bubble generating means such that the stream is around the axis; and classification means (17) adjacent to the opening for collecting the filamentary materials separated from the heterogeneous mixture.

The present invention further relates to the method which comprises: (a) providing an elutriation apparatus including a tubular conduit (10) having a vertically oriented longitudinal axis and opposing upper and lower ends along the axis, wherein the lower end is closed; a tubular transfer tube (13) connected to the upper end of the conduit and leading away from the axis of the conduit with an opening from the branch (14); air bubble generating means (20) through the lower end of the conduit for providing a flow of air bubbles vertically through the conduit and parallel with the axis and out an air vent hole (25); high kinetic energy generating nozzle means for introducing at least one stream of fluid inside the conduit adjacent to the air bubble generating means such that the stream is around the axis; and classification means (17) adjacent to the opening for collecting the filamentary materials separated from the heterogeneous mixture; and (b) elutriating the filamentary material.

SPECIFIC DESCRIPTION

The following Example 1 describes a single elutriation apparatus as shown in FIGS. 1 and 2.

EXAMPLE 1

Materials and Methods

The hydropneumatic elutriation (hydroelute) apparatus of the present invention preferably consists of washing chamber 11 and elutriation chamber 12 in conduit 10, a transfer tube 13, and submerged low kinetic energy screen sieve 14 with fine mesh screens 17 of variable mesh sizes, as shown in FIG. 1. Each unit was constructed of polyvinyl chloride (PVC) drainage pipe, couplers, and reducers (PVC welded together at selected joints by PVC glue (not shown). The washing chamber 11, conduit 10 was constructed by attaching a reducer 11*a* plugged at the bottom by a cap 18 to the elutriation chamber 12 portion of the conduit 10. The transfer tube 13 consisted of one reducer 13*a* for easy connection and removal from the conduit 10 and was connected to a low kinetic energy primary sieve 14. The primary sieve 14 was constructed by clamping teflon screen 17 (840 μm) into the large opening of a reducer 14*a*. The secondary sieve 15 was constructed with clamped teflon screen 19. The primary and secondary screens 14 and 15 were easily replaced by screens of different size depending upon soil and plant types. The purpose of the secondary sieve 15 was to retain all roots during a final wash procedure.

As shown in FIGS. 1A and 1B three spray nozzles 16*a* (T-Jet 8003 available from Spraying Systems Co. Wheaton, Ill. leading from tubes 16 were permanently installed, at 120° spacings, into the wall 11*b* of the high kinetic energy washing chamber 11 for creating a high energy vortex (FIG. 1A). The nozzles 16*a* were directed at an angle for creating a high kinetic energy vortex towards a circular position around the axis of the conduit 10. The air nozzle 20 from line 21 was centered at the base 18 of the chamber 11. The sieve 14 was submerged in liquid 22 in container 23. Air was removed through vent hole 25 in transfer tube 13.

A high energy hydrovortex created by the nozzles 16*a* caused soil to be eroded from the roots and other organic materials. Small air bubbles 24 assisted in removing, by flotation, the organic materials from the coarse mineral debris which remained at the base 18 of the washing chamber 11. Inlet pressures of both the air and water from air nozzle 20 and nozzles 16*a* provided the apparatus with the required energy to wash and separate the fine mineral fraction and biological materials from the coarse mineral fractions. Roots and other organic materials were separated from the fine mineral fraction by a submerged low kinetic energy primary sieve 14. The minimum kinetic energy of water moving across submerged sieve 14 permitted the retention of very fine roots on a relatively coarse screen 17 without breaking laterals and root hairs. Therefore, it was possible to retain both main and lateral roots which were separated from soil materials by the hydroelute apparatus.

EXAMPLE 2

Figure 2A:
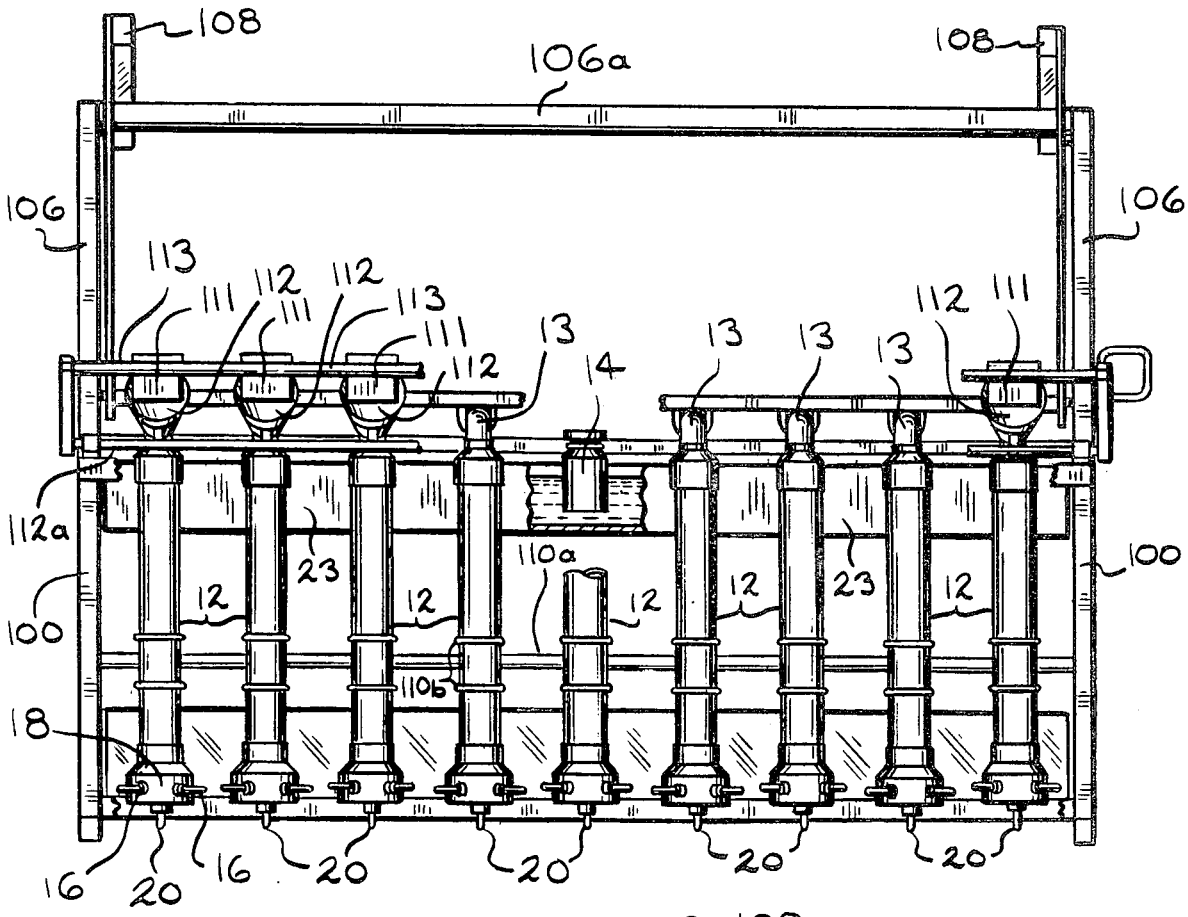
FIG. 2A is a front view of the elutriation apparatus shown in FIG. 2.
Figure 2B:
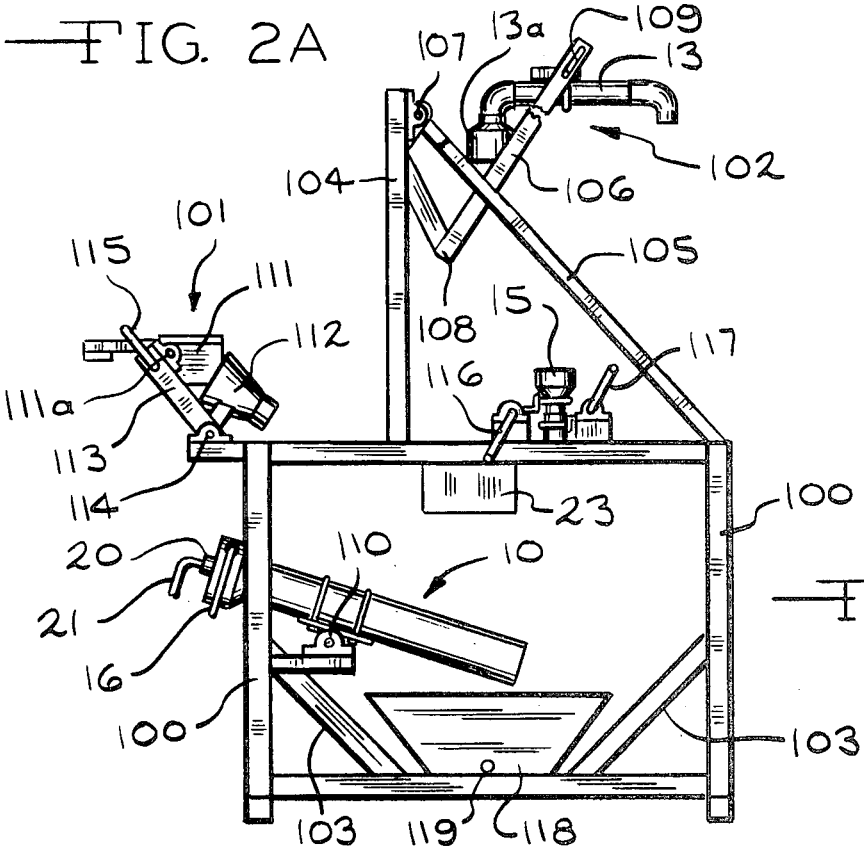
FIG. 2B is a side view as shown in FIG. 2 with a conduit 10 rotated for dumping accumulated solids.

A manifold of nine hydroelute apparatus as shown in FIGS. 2, 2A and 2B was assembled to increase operator efficiency. Any number of apparatus can be combined.

The manifolded apparatus includes a frame 100 mounting nine of the hydroelute apparatus of FIG. 1. The frame is braced by bars 103. The frame 100 supports lever mechanism 102 mounted on bars 104 and 105 supporting moveable lever 106 and 106*a* which acts to lift the tube 13 to open the conduit 10. The lever is pivoted at 107, 108 and 109 to lift the tube 13. The conduit 10 pivots at 110 on bar 110*a*, which supports brackets 110*b* holding conduits 10, to rotate 120° and empty the contents of chamber 11 upon completion of an elutriation cycle as shown in FIG. 2B. Water from the nozzles 16*a* and lines 16 provides for removal of debris (soil).

The samples are delivered by a sample delivery system 101 by means of containers 111 to funnels 112 when the funnels 112 are inserted into the conduits 10, with tubes 13, removed by rotating pivot rod 113. The containers 111 are mounted on pivot rod 113 which pivots at 114 to position the funnels 112. Lever 115 is moved to drop the sample from the container 111 into the funnel 112 by pivoting at 111*a*.

The screened samples in sieve 14 are rotated and inverted into position over second sieve 15 by means of lever 116. The lever 117 is rotated to position second sieve 15 into an inverted position. The primary sieve 14 is stacked over the second sieve 15. The sieve 14 is separated from the tube 13 by means of lever 106. The end of extension 14*c* of sieve 14 (FIG. 1) is inserted into an opening of second sieve 15. The roots are then transferred to the second sieve 15. The second sieve 15 is inverted (FIG. 2 dotted lines) by lever 117 to remove the contents by dumping and washing the sample from the sieve 15. The residue of the conduit 10 and the container 23 and sieve 15 is dumped into trough 118 having a drainage hole 119 as shown in FIG. 2. Water from nozzles 16*a* aid in washing the conduit 10 and base 18.

Two technicians manually operated values (not shown) which controlled the water and air pressure and flow rates in nozzles 16*a* and 20. The nozzle 16*a* fluid vortex released the plant roots from soil materials and carried the roots to the primary sieve 14 via the transfer tube 13. Primary sieves 14 were submerged in the water 22 in container 23. At the end of each washing cycle the nine transfer tubes 13 were raised by lever system 102, and the coarse mineral residue was removed from chambers 11 and 12 by rotating conduit 10 120° toward the inside of the frame 100 as shown in FIG. 2B, and then the conduits 10 were returned to the vertical position as shown in FIGS. 1 and 2 and new samples are placed into the conduits 10 by positioning the sample delivery system 101 directly over each conduits 10. Roots and other organic residue from the samples from sieve 15 are further cleaned by a jet of water, placed in a plastic bag, labeled and preserved with a chemical preservation solution. The entire wash cycle required from 3 to 10 minutes for nine samples.

Utilizing a manifold of nine separation units as shown in FIGS. 2, 2A and 2B, and two technicians, an average of 60 samples could be separated per hour. Water consumption per unit ranges from 2.1 to 3.4 liters per minute.

FIGS. 7, 7A and 7B show multiple apparatus as shown in FIGS. 1 and 1A which are circularly arranged. This is a preferred construction for ease of handling, shipping and requires only one technician for operation; however, functionally the apparatus is similar to that of FIGS. 2, 2A and 2B.

The elutriation apparatus includes the same conduits 10, transfer tubes 13, fluid lines 16, lines 21 and sieve 14 as shown in the Figures related to FIGS. 1 and 2. In this apparatus, the transfer tubes are supported by arms 200 hinged at rotatable hub 201. This allows arms 201 and tubes 13 to be moved out of position as shown in FIG. 2B and conduits 10 to be rotated or turned on plate 202, which is supported on post 203, in order to dump the contents of conduit 10 after the elutriation is completed. The contents are received into pan 204 mounted on legs 205. A drain hole (not shown) is provided in pan 204.

Electrical timers 206 are provided mounted as shown in FIGS. 7, 7A and 7B on plate 202 controlled by a 110 VAC source 207 as shown in FIG. 8. Solonoids 208 open valves (not shown) in line 16 when the timer 206 is actuated to allow the flow of fluid in line 16 to the base 18 of conduit 10 and nozzles 16*a* (not shown in FIG. 8). This allows the operator to control the flow of fluid to the nozzles 16*a* automatically.

The sieves 14 are submerged in water in tray 210 which drains into pan 204. The sieves are removed from tray 10 for collection of the samples.

In operation a single operator is able to feed samples to each conduit 10, replace the transfer tube 13 on the conduit 10, actuate the timer 206 with the air generating apparatus continually activated. The hub 201 is rotated to the operator's station so that each conduit 10 is loaded and timed in turn. Upon completion of the cycle of 8 tubes, the timers are then allowed to close the solonoid 208 controlled values on the first elutriation and then each transfer tube 13 is lifted on arm 200 and conduit 10 is rotated to dump the contents. Timer 206 can be activated to allow flushing of the base 18 of conduit 10.

RESULTS AND DISCUSSION

Efficiency of Separation

The time required for quantitatively separating root materials from the root and soil sample by the hydroelute manifolded apparatus of FIGS. 2 and 2A was approximately 100 seconds per sample. This rate of separation is nearly six fold greater than previous methods used by us or than reported in the literature (Bohm et al. 1977). Table 1 indicates the time and labor cost effectiveness of the hydroelute manifolded apparatus of FIGS. 2 and 2A.

TABLE 1

Comparison of time requirements for separating roots from nonsoaked medium-textured soil materials

| Method | Processing rate samples/hour | Labor inputs min/sample |
|---|---|---|
| Conventional* | 6 | 10 |
| Hydroelute manifold | 72 | 1.7 |

*Bohm et al (1977)

Figure 3:
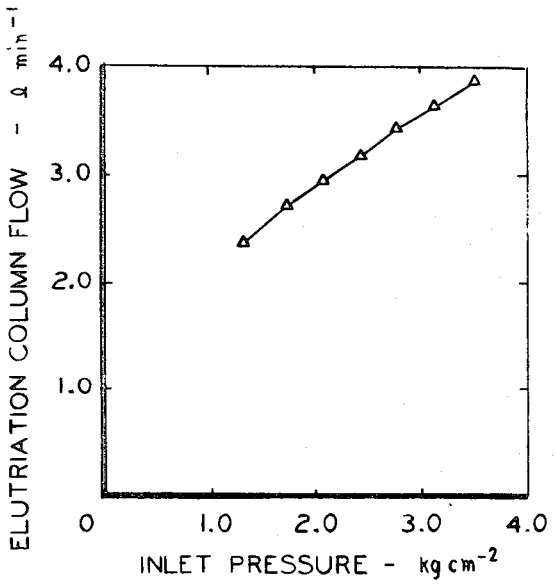
FIG. 3 shows the relative elutriation flow response of three T-jet nozzles 16 to inlet water pressure in the elutriation apparatus. Although there is a direct relationship, the rate of flow is a function of the number and size of the nozzles.

The time required to completely wash plant roots free of soil is a function of water pressure, soil texture, soil compaction, and sample size. FIG. 3 indicates a direct relationship between the water pressure at the nozzle 16 of the high kinetic energy washing chamber 11 and the flow of water through the elutriation conduit 10. A similar relationship has been observed between inlet pressure and run time for separating roots from a given textured soil. The use of different sized nozzles 16 will modify both the flow rate and kinetic energy of the apparatus. Therefore it is important to select specific nozzle 16 sizes and flow rates which maximize separation efficiency and thus is easily accomplished by those skilled in the art. Pressures used for the Michigan plant and soil conditions ranged from 2.25 to 3.9 kg $cm^{-2}$. Since excessive effervescence interfered with the active water vortex, it was necessary to use low air pressures (0.7 $kg/cm^2$) during the washing cycle. However, a large pulse of air at the end of the elutriation time was generally beneficial for clearing large root segments from the reducer 13*a* at the top of the elutriation conduit 10.

Texture of the root and soil sample greatly influenced the rate at which roots accumulated on the low kinetic energy primary screen as shown in FIG. 4. The elutriation time necessary to recover 97% of all the roots which accumulated on a 75 mesh to 75 micrometer sieve, increased from 3 to 10 minutes as the texture of the soil media was changed from a coarse sand to a Conover loam (fine-loamy mixed mesic Udolic Ochraqualf) to a Charity clay (fine illitic calcareous mesic Aeric Haplaquept). The remaining 3% of the roots were washed free of the soil sample by continuously washing for an additional 5 to 10 minutes. Generally, the size and bulk density of the sample had little effect upon elutriation time when sample size ranged from 115 to 825 cc or bulk densities ranged from 1.1 to 1.6 g/cc. After each run, coarse soil residues were expelled from the conduit 10 by rotating the entire hydroelute conduit 10 120° with the water pressure on.

FIG. 3 shows the flow rate of water in liters per minute compared to water pressure at the nozzles 16*a*. There is a direct relationship. FIGS. 4, 5 and 6 show the recovery of roots based as a percentage of dry weight as a function of elutriation time in minutes. FIG. 4 shows treatment of various soil textures. One hundred percent of the roots washed free of soil were those which traversed the primary sieve (14) and were retained on a standard 75 micrometer sieve. Inlet pressures of water and air, through tubes 16 and line 21, were 3.9 and 0.7 kg air, respectively. FIG. 5 shows different root recoveries from clay based upon soaking in sodium hexametaphosphate. FIG. 6 shows the recovery of different plant roots grown in sand for two weeks thus evidencing the recovery of very fine root samples from spectrum of plate root systems. The importance of FIGS. 4 to 6 is that virtually complete recovery of intact roots can be achieved under the stated conditions.

FIG. 5 suggests that the chemical dispersant, sodium hexametaphosphate, appears to expedite the process of separating roots from clay materials by the hydroelute apparatus. The disadvantages of presoaking include greater labor inputs, root discoloration, and severe disruption of root tissue. Therefore, the incorporation of chemical dispersants into the washing process are not preferred. Efforts to increase separation efficiency by sonication or soaking in water proved to be of little value. Further fractionation into subsamples combined with presoaking, decreased the elutriation time.

Maximum recovery of roots is a function of screen size, rather than incomplete removal of roots from soil particles, as can be seen from FIGS. 4, 5 and 6. As the screen size is reduced, however, the diameter of the primary sieve 14 must be increased to prevent plugging, especially when roots are washed from soils containing a high precent of very fine sand or silt materials.

The hydroelute system efficiently separates plant roots of both legumes and grasses from the mineral soil fraction as shown by FIG. 6. There also appeared to be a difference in the rates at which the roots from different plant types were released and recovered for a given elutriation time. Experience with several varieties of dry beans has indicated that roots from the same cultivar are uniformly released from similar soil types. Physical conditions of the soil (e.g., excessive compaction, texture, etc.) influence the time necessary to quantitatively separate all roots from the soil sample. Since nondisturbed samples taken from compacted clay soil experiments (Srivastava, A. K. et al. Am. Soc. Agric. Eng. Trans. 25:(4) (In press) (1982)) must generally be washed for 10 to 15 minutes it was a routine practice to presoak these clay samples in 50 g/liter of sodium hexametaphosphate solution for a period of 16 hours. Presoaking roots of dry beans for periods greater than 16 hours generally results in their discoloration, reducing the number of measurement options (Voorhees, W. B., et al. Agron, J. 72:847–851 (1980)). Therefore, many of the root-soil samples were washed without presoaking. Mechanical sampling by the method of Srivastava et al combined with the hydroelute washing of fresh field samples, enabled the separation of many biological materials from soils without destroying their viability and/or integrity. Consequently, root samples separated by the hydroelute apparatus may be analyzed for many root-soil interface associations.

Current measurement of roots from selected field samples include: (1) length by the computer-controlled digital scanning method of Voorhees et al; (2) morphological characteristics (i.e., nodulation, root branching, porosity, etc.); (3) content of bound nutrients; (4) certain pathogenic and non-pathogenic bacterial and fungal infections; (5) $^{14}C$ partitioning of field grown plants; (6) genetic diversity of isoline root systems; and (7) toxic metabolite and enzyme contents of field grown plant roots. Observations indicate that the hydropneumatic elutriation apparatus may be used for determining population densities and distribution of weed seeds, soil animals, insects, and other macroflora, and partially decomposed plant debris, which are currently being separated manually. This efficient, quantitative, and inexpensive approach to determine root responses to soil conditions is a method which should advance the understanding of the responses of roots and other biological materials to soil field conditions. It is believed that the hydroelute apparatus will significantly contribute to future developments in many disciplines of the plant, soil, forensic, and zoological sciences.

We claim:

1. An elutriation apparatus for the separation and classification of a heterogeneous mixture of solids including filamentay biological materials and having components with different specific gravities by means of a liquid and air classification which comprises:

(a) a tubular conduit (10) having a vertically oriented longitudinal axis and opposing upper and lower ends along the axis, wherein the lower end is closed;

(b) a tubular transfer tube (13) connected to and closing the upper end of the conduit and leading away from the axis of the conduit with an opening from the tube for removing a liquid flowing through the conduit and the tube;

(c) air bubble generating means (20) through the lower end of the conduit for providing a flow of air bubbles vertically through the conduit and parallel to the axis and out an air vent hole (25);

(d) high kinetic energy generating nozzle means mounted on the conduit (16*a*) and directed inward at an angle for introducing at least one stream of the liquid inside the conduit adjacent to the air bubble generating means such that the stream is directed inwardly as a high energy vortex around the axis of the conduit; and (e) classification means (17) adjacent to the opening from the tube for collecting the filamentary materials separated from the heterogeneous mixture.

2. The apparatus of claim 1 wherein the transfer tube has a longitudinal portion perpendicular to the axis of the conduit and a vertical portion positioned such that the opening is downwardly directed along a second axis which is parallel to the axis of the conduit and wherein the lower end of the conduit is wider than the upper end.

3. The apparatus of claim 1 wherein the classification means is a screen (17) over the opening with a mesh size for retaining the filamentary biological material and wherein a container is provided to immerse the screen in the classification liquid during classification.

4. The apparatus of claim 1 wherein the conduit is mounted on a frame (100, 202) and is separable from the transfer tube and wherein the conduit is rotatable perpendicular to the conduit axis in order to provide for emptying retained solids at the lower end of the conduit after use of the elutriation apparatus with the transfer tube separated.

5. The apparatus of claim 4 wherein multiple of the conduits are mounted on the frame.

6. The apparatus of claim 5 wherein the multiple of the conduit are linearly aligned with their conduit axes parallel to each other.

7. The apparatus of claim 5 wherein the multiple conduits are positioned circularly (200, 201) on the frame about a central axis of the frame with their conduit axis parallel to each other and wherein the conduits are rotatable with the transfer tube separated towards the central axis perpendicular to the conduit axis so as to empty then into a collector (204) provided around the central axis of the frame and wherein a container (210) is provided which submerges each of the openings which is covered with a screen for retention of the filamentary biological material during liquid classification.

8. The apparatus of claim 4 wherein a solenoid (208) controlled by a timer (206) is provided to control a valve in a tube (16) for the stream of fluid to the nozzle means for providing a timed period of fluid flow.

9. The apparatus of claim 1 wherein a solenoid (208) controlled by a timer (206) is provided to control a valve in a tube (16) for the stream of fluid to the nozzle means for providing a timed period of fluid flow.

10. A method for the separation and classification of a heterogeneous mixture of solids including filamentary biological materials having different specific gravities by means of a liquid and air classification which comprises:

(a) providing an elutriation apparatus including a tubular conduit (10) having a vertically oriented longitudinal axis and opposing upper and lower ends along the axis, wherein the lower end is closed;

a tubular transfer tube (13) connected and closing to the upper end of the conduit and leading away from the axis of the conduit with an opening (14) from the tube for removing a liquid flowing through the conduit and the tube;

air bubble generating means (20) through the lower end of the conduit for providing a flow of air bubbles vertically through the conduit and parallel with the axis and out an air vent hole (25);

high kinetic energy generating nozzle means mounted on the conduit and directed inwardly at an angle for introducing at least one stream of the liquid inside the conduit adjacent to the air bubble generating means such that the stream is directed inwardly as a high energy vortex around the axis of the conduit; and classification means (17) adjacent to the opening from the tube for collecting the filamentary organic material separated from the heterogeneous mixture;

(b) placing a supply of said mixture in the conduit;

(c) elutriating the filamentary organic materials by introducing air bubbles thru the lower end of the conduit flowing the liquid through the nozzles through the conduit and transfer tube and into the classification means and collecting the remaining solids in the lower end of the conduit;

(d) collecting the filamentary organic materials from the classification means; and (e) removing the solids from the lower end of the conduit.

11. The method of claim 10 wherein the filamentary organic material which is elutriated is plant roots and the remaining solid is earth.

12. The method of claim 10 wherein the filamentary biological material which is elutriated is animal fibers and the remaining solid is earth.

13. The method of claim 10 wherein a dispersing agent is used to facilitate the separation of the filamentary biological materials from the remaining solids.

14. The method of claim 13 wherein the dispersing agent is sodium hexametaphosphate.

* * * * *